US010160528B2

(12) United States Patent
Lamentowicz et al.

(10) Patent No.: US 10,160,528 B2
(45) Date of Patent: Dec. 25, 2018

(54) HANDLING DEVICE FOR AN INSTALLABLE AND RETRIEVABLE SUBSEA APPARATUS

(71) Applicant: Aker Solutions AS, Lysaker (NO)

(72) Inventors: Michal Sebastian Lamentowicz, Kongsberg (NO); Viggo Lauritz Norum, Kongsberg (NO); Roald Pedersen, Kongsberg (NO); Lars Lein, Kongsberg (NO); Jan Øyen, Skollenborg (NO); Odd Harald Brøndbo, Hokksund (NO); Devraj Sonavane, Pune (IN); Einar Winther-Larssen, Oslo (NO)

(73) Assignee: Aker Solutions AS, Lysaker (NO)

( * ) Notice: Subject to any disclaimer, the term of this patent is extended or adjusted under 35 U.S.C. 154(b) by 0 days.

(21) Appl. No.: 15/511,999

(22) PCT Filed: Sep. 17, 2015

(86) PCT No.: PCT/NO2015/050163
§ 371 (c)(1),
(2) Date: Mar. 16, 2017

(87) PCT Pub. No.: WO2016/043599
PCT Pub. Date: Mar. 24, 2016

(65) Prior Publication Data

US 2017/0247093 A1 Aug. 31, 2017

(30) Foreign Application Priority Data

Sep. 19, 2014 (NO) ..... 20141134

(51) Int. Cl.
*B63C 11/34* (2006.01)
*E21B 41/04* (2006.01)
(Continued)

(52) U.S. Cl.
CPC ..... *B63C 11/52* (2013.01); *B63B 2027/165* (2013.01); *B63G 2008/005* (2013.01)

(58) Field of Classification Search
CPC ..... B63C 11/34; B63G 2008/005; B63G 2008/007; B63G 2008/008; E21B 41/04
(Continued)

(56) References Cited

U.S. PATENT DOCUMENTS 3,520,358 A * 7/1970 Brooks ..... E21B 33/076 166/356
3,635,184 A 1/1972 Liautaud
(Continued)

FOREIGN PATENT DOCUMENTS

GB 2413639 A 11/2005
GB 2493253 A 1/2013
NO 324823 B1 12/2007

OTHER PUBLICATIONS

Toll, Anders, "International Search Report" prepared for PCT/NO2015/050163; dated Jan. 18, 2016; 5 pages.

*Primary Examiner* — Benjamin F Fiorello
*Assistant Examiner* — Edwin J Toledo-Duran
(74) *Attorney, Agent, or Firm* — Winstead PC

(57) ABSTRACT

A handling device (1) for an installable and retrievable subsea apparatus (2) to engage a docking device (3) on a subsea installation, the docking device (3) having a pair of engagement members (4, 5). The device (1) is provided with a top member (6) and a pair of engagement arms (7, 8) depending therefrom to extend along the outside of the apparatus (2). Each of the arms (7, 8) at a free end thereof is provided with a hook (7', 8') configured to engage in releasable way the engagement members (4; 5). A rotatable handle (9) is located above the top member (6) and has an integral or linked stem (10) which extends through the top member (6) and is pivotally linked to a top region of the
(Continued)

apparatus (2). The handle (9) is able to operate the engagement arms (7, 8) relative to the engagement members (4,5).

4 Claims, 4 Drawing Sheets

(51) Int. Cl.
*B63C 11/52* (2006.01)
*B63B 27/16* (2006.01)
*B63G 8/00* (2006.01)

(58) Field of Classification Search
USPC ..... 405/188, 190, 191; 138/338, 339, 340, 138/341
See application file for complete search history.

(56) References Cited

U.S. PATENT DOCUMENTS

RE27,745 E * 8/1973 Brooks et al. ..... B63C 11/42 166/336
3,953,982 A * 5/1976 Pennock ..... E21B 19/002 405/168.1
4,030,309 A * 6/1977 Mason ..... B63C 11/40 114/50
4,120,362 A * 10/1978 Chateau ..... E21B 41/04 166/339
4,138,148 A 2/1979 Zaremba
4,175,620 A * 11/1979 Nolan, Jr. ..... E21B 43/0135 166/343
4,443,129 A * 4/1984 de Sivry ..... B63C 11/40 405/168.1
4,557,628 A * 12/1985 Cowan ..... B63B 21/60 166/54.5
4,611,953 A * 9/1986 Owens ..... E02D 27/50 114/294
4,661,017 A * 4/1987 Wood ..... E21B 43/013 405/169
4,730,677 A * 3/1988 Pearce ..... E21B 17/015 166/345
4,746,246 A * 5/1988 Cowan ..... B63B 21/60 166/339
4,753,552 A * 6/1988 Karal ..... B63G 8/001 114/314
4,805,951 A * 2/1989 Andersson ..... B23Q 7/043 294/116
4,832,530 A * 5/1989 Andersen ..... F16L 1/26 285/39
4,842,075 A * 6/1989 Kalvenes ..... E21B 43/0135 166/341
4,860,681 A * 8/1989 Svenning ..... B63C 11/40 114/321
5,069,580 A * 12/1991 Herwig ..... B63C 11/34 405/188
5,146,989 A * 9/1992 Rouse ..... E21B 19/002 166/339
5,318,115 A * 6/1994 Rouse ..... E21B 4/02 166/361
5,458,439 A * 10/1995 Hall ..... F16L 1/26 405/158
5,593,249 A * 1/1997 Cox ..... E21B 41/04 405/169
6,029,745 A * 2/2000 Broussard ..... E21B 31/16 166/298
6,068,427 A * 5/2000 Østergaard ..... E21B 33/035 166/345
6,234,717 B1 * 5/2001 Corbetta ..... E21B 41/04 405/158
6,276,625 B1 * 8/2001 Chee ..... G06Q 40/04 114/312
6,644,410 B1 * 11/2003 Lindsey-Curran ..... E21B 33/0355 166/338
7,112,009 B2 * 9/2006 Mackinnon ..... E21B 41/04 166/343
7,181,980 B2 * 2/2007 Wium ..... G01F 1/74 73/861.04
7,318,479 B2 * 1/2008 Williams ..... E21B 23/006 166/341
7,704,016 B2 * 4/2010 Gransaether ..... E21B 41/04 166/338
8,307,903 B2 * 11/2012 Redlinger ..... E21B 29/005 166/341
8,353,350 B2 * 1/2013 Overfield ..... E21B 33/0385 166/250.01
9,222,328 B2 * 12/2015 Stokes ..... E21B 23/006
9,988,129 B2 * 6/2018 Jamieson ..... B63G 8/001
2002/0040782 A1 * 4/2002 Rytlewski ..... B63G 8/001 166/341
2002/0040783 A1 * 4/2002 Zimmerman ..... B63G 8/001 166/366
2003/0167997 A1 * 9/2003 Colyer ..... E21B 41/04 114/258
2005/0145389 A1 * 7/2005 Barrow ..... E21B 29/005 166/361
2005/0241410 A1 * 11/2005 Wium ..... G01F 1/74 73/861.04
2007/0227740 A1 * 10/2007 Fontenette ..... E21B 33/038 166/344
2007/0253158 A1 * 11/2007 Gransaether ..... E21B 33/0385 361/679.44
2008/0035327 A1 * 2/2008 Fowkes ..... E21B 41/04 166/85.5
2008/0264643 A1 * 10/2008 Skeels ..... E21B 33/076 166/348
2012/0090152 A1 * 4/2012 White ..... E21B 41/04 29/464
2013/0025419 A1 1/2013 Opstad
2013/0058732 A1 * 3/2013 Anda ..... B23B 29/03432 408/108
2015/0086299 A1 * 3/2015 Jamieson ..... B63G 8/001 414/139.6
2015/0239538 A1 * 8/2015 Jewell ..... B63C 1/12 405/190
2016/0167756 A1 * 6/2016 Wolfenbarger ..... B63G 8/001 114/338
2016/0297502 A1 * 10/2016 Heiler ..... B63B 35/44
2016/0318591 A1 * 11/2016 Jamieson ..... H02J 7/025
2018/0148301 A1 * 5/2018 Canny ..... E21B 29/12
2018/0162503 A1 * 6/2018 Reid ..... B63G 8/00

* cited by examiner

HANDLING DEVICE FOR AN INSTALLABLE AND RETRIEVABLE SUBSEA APPARATUS

BACKGROUND OF THE INVENTION

The present invention relates to a handling device for an installable and retrievable subsea apparatus, the subsea apparatus in a releasable manner to engage an apparatus mating ISO standardized docking device on a subsea installation, the docking device having a pair of outwardly extending engagement members having an aperture and an engagement rim, as defined in the preamble of claim 1.

The prior art solutions comprises means and methods of attachment and securing a subsea apparatus to a docking device of a subsea installation, and these solutions rely on a complex multi-step procedure which may require several tools and/or multiple handling operations to be available to a ROV which is to install or retrieve the apparatus. The prior art also relies on a number of movable parts within the connection interface to provide a latching or locking mechanism.

OBJECT OF THE INVENTION

It is an object of the invention to overcome the complexity and disadvantages related to the prior art solutions in order to enable the subsea apparatus, sometimes known as a retrievable module, to be locked to another module or actuator subsea by aid from a ROV (Remotely Operated Vehicle), using existing known ROV tools and capabilities. The invention is intended to cooperate with and be able to docket a lower region of the apparatus in a "female" ISO-standardized, e.g. "ISO class 4-type" docking device, frequently known as a "connection bucket" without any alterations of the docking device.

Further, the invention has as an object to provide a robust, easy to handle and easy to use device for the co-operation with the ROV and which does not require a complex linkage or depend on tightly guided elements, and in addition provides for a clear, optically readable indication of a locked status of the apparatus in the docking device.

Contrary to the prior art related to securing such connections, the inventive device is very simple, robust and easy to use. It provides a good interface to the ROV which will assist the installation or retrieving of the apparatus.

SUMMARY OF THE INVENTION

According to the invention, the handling device is characterized in:

that the device is configured as a yoke which is provided with a top member and a pair of engagement arms depending therefrom to extend along an outside face of the apparatus, that each of the arms at a free end thereof is provided with a hook configured to engage in a releasable manner a rim on the docking device, that a rotary handle is located above the top member and has an integral or linked stem which extends through the top member and is pivotally linked to a top region of the apparatus, that the handle and its stem in a first rotary position are movable transversely of the top member between set limits, but are rotationally locked relative a main body of the apparatus hanging freely from the stem, that the handle and its stem are locked and prevented from any movement relative to the top member when in a second rotary position with the handle closest to the top member and with the arm hooks in engagement with the docking device rims, and thereby locking docking engagement between the apparatus and the docking device, and that a rear side of the hooks is inclined to gradually engage a lower region of the apparatus and upon its movement into the ISO docking device to cause the hooks to be pressed into and held in engagement with the docking device rims.

The arrangement of the handle and the stem relative to the top member of the handling device as well as relative to the main body of the apparatus enables an easy and safe way of lowering or lifting, i.e. handling the apparatus to and from a docking device using the handle.

According an embodiment of the handling device, the stem is provided with a pair of engagement pegs configured upon rotation of the handle and stem to engage, climb on and come to rest on an underside portion of the top member facing the apparatus.

According to another embodiment of the handling device, the top member is provided with a spring to assist the apparatus to move from a first position to a second position over a limited distance away from the top member when the hooks have entered into engagement with said rims.

According to a further embodiment of the handling device, the handle and its stem are in a rotary mode when the apparatus is adjacent or at said second position.

The invention is now to be described with reference to the attached drawings which illustrate in an exemplifying, non-limiting manner aspects of the handling device and its operation.

DETAILED DESCRIPTION OF THE INVENTION

Figure 1:
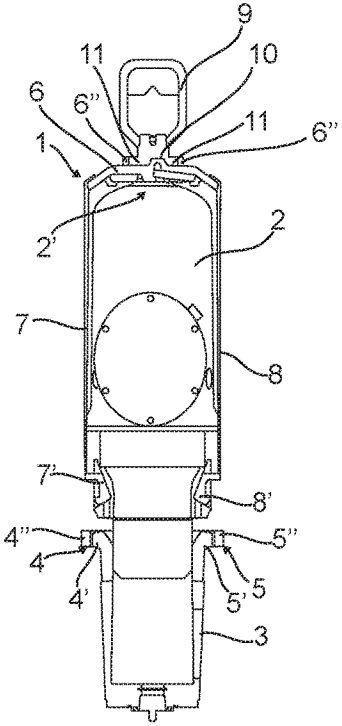
FIG. 1 shows the operation of a handling device of the invention in a first phase of installation of a subsea apparatus.

The present invention comprises a handling device 1 for an installable and retrievable subsea apparatus 2, the subsea apparatus in a releasable manner to engage an apparatus mating ISO standardized docking device 3 on a subsea installation. The docking device 3 has a pair of outwardly extending engagement members 4, 5 having an aperture 4'; 5' and an engagement rim 4"; 5". The device is configured like a yoke which is provided with a top member 6 and a pair of engagement arms 7, 8 depending therefrom to extend along an outside face of the apparatus 2. Each of the arms 7; 8 is at a free end thereof provided with a hook 7'; 8' configured to engage in a releasable manner the rim 4"; 5", respectively, on the docking device 3.

A rotary spindle or male member (not shown) may be located in the docking device 3 and linking such member e.g. with a valve spindle in the subsea installation.

A rotary handle 9 is located above the top member 6 and has an integral or linked stem 10 which extends through the top member 6 and below the top member 6 is pivotally linked to a top region 2' of the apparatus 2. The handle 9 is configured to be engaged by an ROV (not shown).

Figure 2:
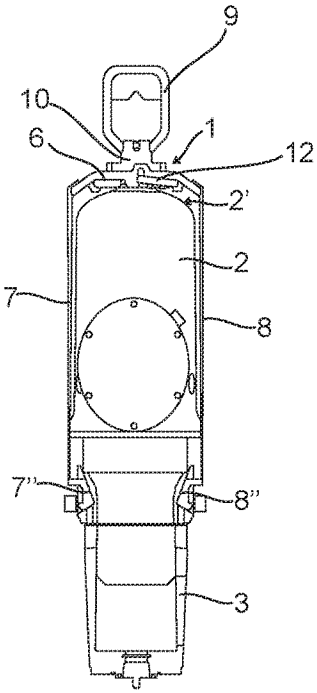
FIG. 2 shows the operation of a handling device of the invention in a second phase of installation of a subsea apparatus.
Figure 3:
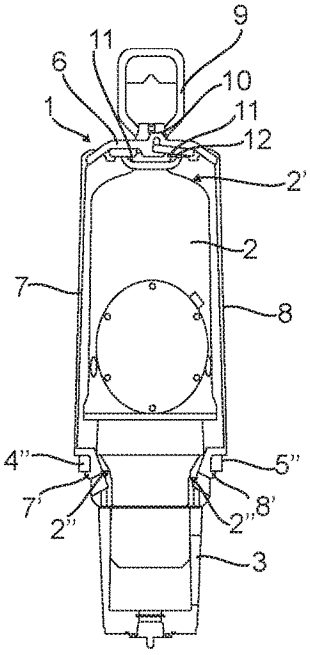
FIG. 3 shows the operation of a handling device of the invention in a third phase of installation of a subsea apparatus.
Figure 4:
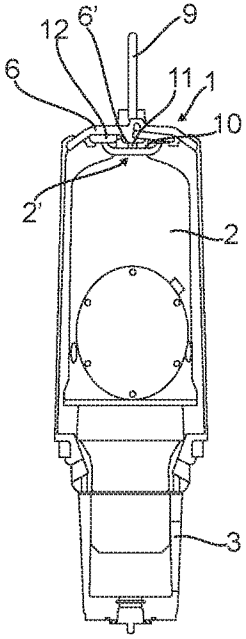
FIG. 4 shows the operation of a handling device of the invention in a fourth phase of installation of a subsea apparatus.
Figure 5:
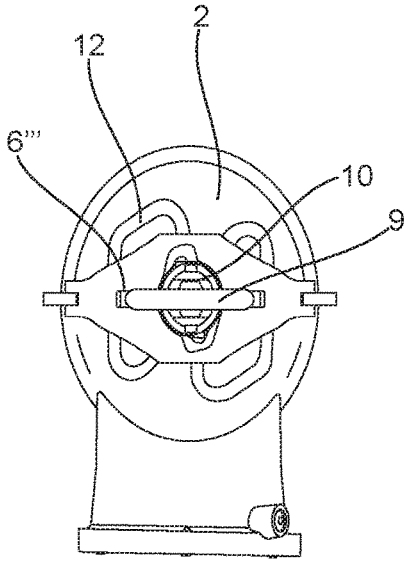
FIG. 5 is a view from above of the views of FIGS. 1-3.
Figure 6:
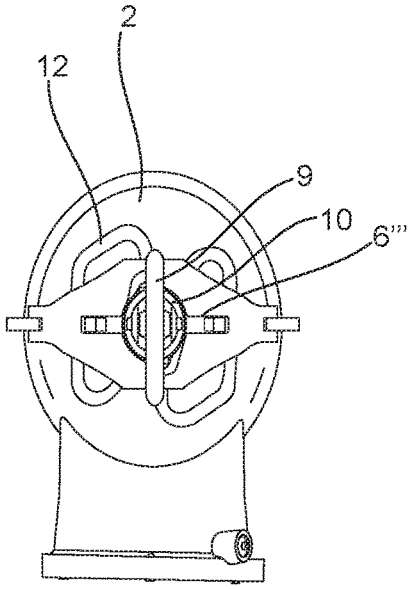
FIG. 6 is a view from above of the view of FIG. 4.
Figure 9:
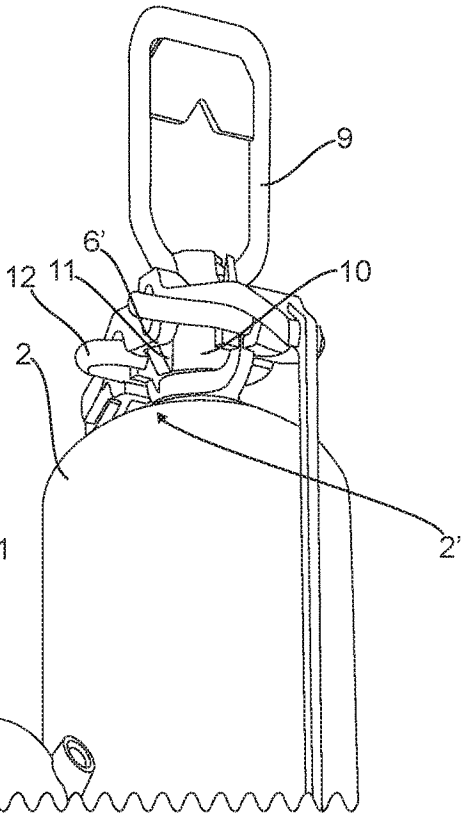
FIG. 9 is a front perspective view from one side of a top region of the handling device, related to the view of FIG. 4.
Figure 8:
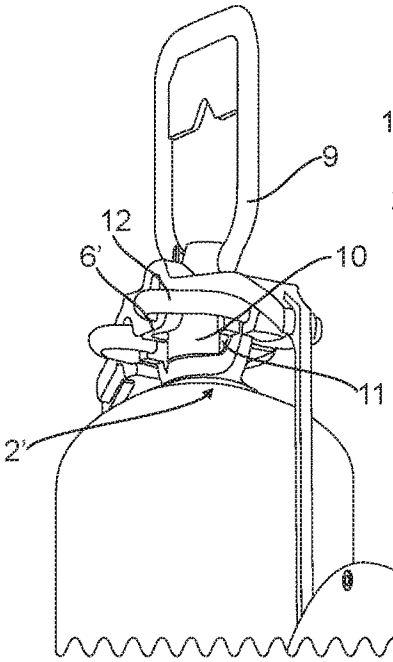
FIG. 8 is a front perspective view from one side of a top region of the handling device, related to the view of FIG. 3.
Figure 7:
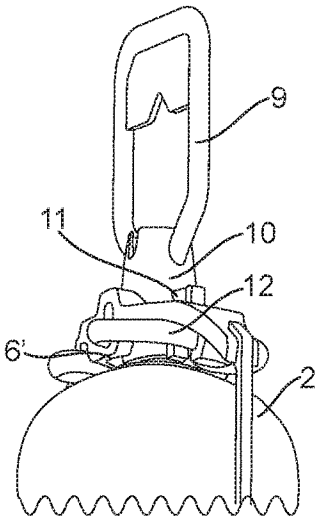
FIG. 7 is a front perspective view from one side of a top region of the handling device, related to the view of FIGS. 1 and 2.
Figure 12:
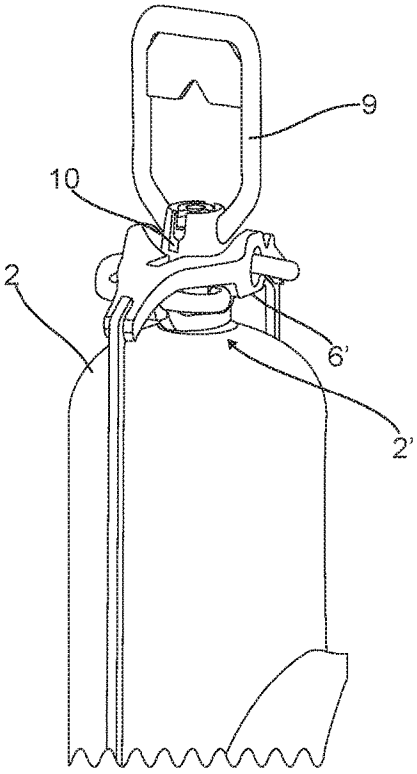
FIG. 12 is a front perspective view from another side of a top region of the handling device, related to the view of FIG. 4.
Figure 11:
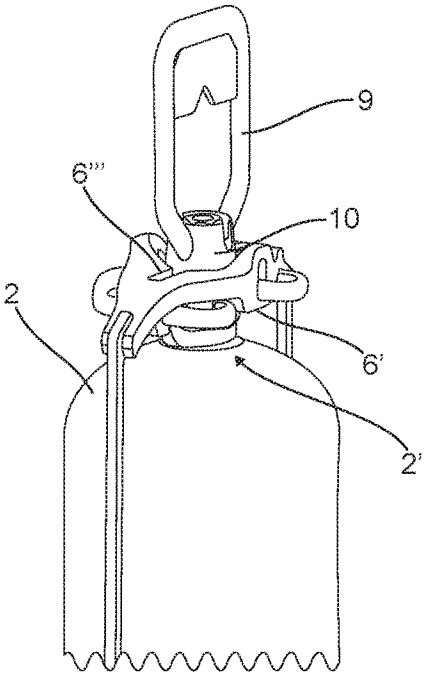
FIG. 11 is a front perspective view from another side of a top region of the handling device, related to the view of FIG. 3.
Figure 10:
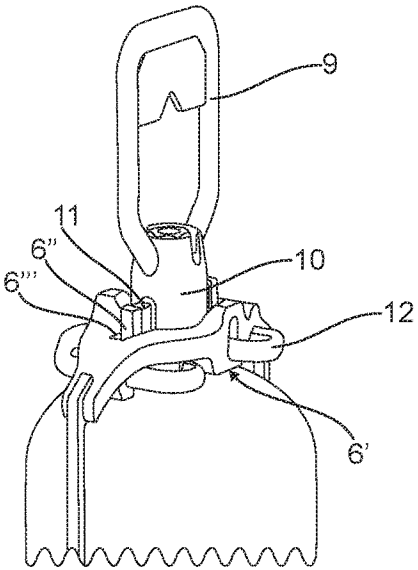
FIG. 10 is a front perspective view from another side of a top region of the handling device, related to the view of FIGS. 1 and 2.

The handle 9 and its stem 10 are in a first rotary position as shown on FIGS. 1-3 movable transversely of the top member 6 between set limits, but are rotationally locked relative a main body of the apparatus 2 hanging freely from the stem 10.

As shown on FIGS. 4, 6, 9 and 12, the handle 9 and its stem 10 are in a second rotary position with the handle 9 closest to the top member 6 and with the arm hooks 7', 8' in engagement with the docking device rims 4", 5", and are locked and prevented from any movement relative to the top member 6.

A rear side 7", 8' of the hooks 7, 8 is inclined to gradually engage an inclined portion of a lower region 2" of the apparatus 2. Upon the apparatus movement into the ISO docking device 3, the hooks 7, 8 will be caused to be pressed into and held in engagement with the docking device rims 4", 5".

The arrangement of the handle 9 and the stem 10 relative to the top member 6 of the handling device 1 as well as relative to the main body of the apparatus 2 enables an easy and safe way of lowering or lifting, i.e. handling the apparatus to and from the docking device 3 using the handle 9.

The stem 10 is provided with a pair of engagement pegs 11 configured upon rotation of the handle 9 and stem 10 to engage, climb onto and come to rest on an underside portion 6' of the top member 6 facing the apparatus 2. Note that the pair of pegs 11 is visible on FIGS. 1, 2 and 3, however only one of the pegs being visible on FIGS. 4, 7, 8, 9 and 10.

As shown on FIGS. 1, 2, 7 and 10 the pegs 11 engage an abutment 6" of the top member 6 as well as partly a slot 6'" in the top member, and these "pegs arrest means" thereby prevent and lock the handle 9 and its stem 10 from a rotational movement in the first rotary position of the handle 9 when it is as far as possible away from the top member 6.

As will be observed from inspecting the drawings, a same relative movement of the apparatus 2 relative to the hooks 7, 8 and the docking device 3 will disengage a rotational locking of the handle 9. Disengagement is made possible as the pegs 11 are moved below the top member 6, thereby leaving locking engagement with the abutment 6" and the slot 6'", see FIGS. 3, 4, 8 and 9.

The top member 6 is provided with a spring 12 which assists in defining two axially distinct positions of the handle 9 and its stem 10, as well as the apparatus 2, i.e. when the apparatus 2 moves from a first position as e.g. shown on FIG. 2 to a second position as e.g. shown on FIG. 3 over a limited distance away from the top member 6 when the hooks 7', 8' have entered into engagement with said rims 4", 5". The spring 12 also assures that the handle 9 (and its stem 10) cannot change position without a required operational torque to be applied to the handle, thereby safe-guarding that the handle 9 and the stem 10 do not intentionally switch positions relative to the top member 6 of the handling device 1.

As indicated above, when the apparatus 2 is properly docketed in the device 3, the lower region 2" of the apparatus prevents the hooks 7', 8' from dislodging from the rims 4", 5". It will be noted that the handle 9 and its stem 10 are in a rotary mode, i.e. free to rotate from the first rotary position to the second rotary position, suitably rotation through 90°, when the apparatus 2 is adjacent or at said second position, as shown on FIGS. 3 and 4.

By turning the handle 9 and the stem 10 into the position shown on FIGS. 4, 6, 9 and 12, the docking engagement of the apparatus 2 into the docking device 3 is effectively locked, along with the hooks 7', 8' being locked to the rims 4", 5". Thus, the apparatus is properly clamped into position in axial direction in the docking device, which yields a positive arrest of the apparatus about its longitudinal axis.

The top member 6 is effectively lifted over the projecting pegs 11 on the handle stem 10 when the apparatus is fully inserted into the ISO docking device or "bucket", enabling the ROV to rotate the handle 9 to provide a positive confirmation the locked state.

The top member 6 is movable in the axial direction relative to the apparatus 2, but is not movable in radial direction relative to the apparatus 2. As will be appreciated from studying the drawings, the arms 7, 8 are attached to top member and depend therefrom. The arms 7, 8 are movable substantially in the axial direction of the apparatus 7 when there is a corresponding axial movement of the top member 6. Further, they are flexible to be slightly bendable sideways relative to a respective adjacent side of the apparatus 2, as is clearly visible from studying FIGS. 1-4. By geometry, the sides, i.e. the arms 7, 8, of the top member 6 are pointing inwards towards each other when the handling device is "free". This implies that the arms and their hooks 7', 8' will always be controlled radially by the inclined faces at the lower region 2" of the apparatus 2. The angular position of the handle 9 provides a visible "flag" for a camera on the ROV.

It is understood that the top member has a certain, suitably high stiffness, although it will still flex somewhat when loaded, thus ensuring that tension of the locking state is maintained during the course of time.

The invention provides for a reduction in complexity of latching operation, a reduction of number of required part, cost, and reliability improvement due to fewer movable parts, compared to typical prior art worm-screw latch arrangement.

It will be appreciated that when the apparatus 2 is to be released from engagement with the docking device, the steps as indicated in FIGS. 1-4 are simply reversed. Once the handle 9 is turned into the position in FIG. 3 and is pulled, the apparatus 2 comes closer to the top member 6 and the lower region 2" of the apparatus 2 reduces its engagement with the inclined faces 7", 8", thereby causing the hooks 7', 8' to move slightly towards each other and enter out of engagement with the rims 4", 5", and thereby resulting in the fully released state as shown on FIG. 1.

The invention claimed is:

1. A handling device for an installable and retrievable subsea apparatus, the retrievable subsea apparatus in a releasable manner to engage an apparatus mating docking device on a subsea installation, the apparatus mating docking device having a pair of outwardly extending engagement members having an aperture and an engagement rim, the handling device comprising:

a top member and a pair of engagement arms depending therefrom to extend along an outside face of the retrievable subsea apparatus, wherein the handling device is configured as a yoke;

wherein each of the engagement arms at a free end thereof is provided with a hook configured to engage in a releasable manner a rim on the apparatus mating docking device;

a rotary handle that is located above the top member and has an integral or linked stem which extends through the top member and is pivotally linked to a top region of the retrievable subsea apparatus;

wherein the rotary handle and the stem in a first rotary position are movable transversely of the top member between set limits, but are rotationally locked relative a main body of the retrievable subsea apparatus hanging freely from the stem;

wherein the rotary handle and the stem are locked and prevented from any movement relative to the top member when in a second rotary position with the rotary handle closest to the top member and with the engagement arm hooks in engagement with rims of the apparatus mating docking device, and thereby locking docking engagement between the retrievable subsea apparatus and the apparatus mating docking device; and wherein a rear side of the hooks is inclined to gradually engage a lower inclined region of the retrievable subsea apparatus and upon movement into the apparatus mating docking device to cause the hooks to be pressed into and held in engagement with the rims of the apparatus mating docking device.

2. The handling device of claim 1, wherein the stem is provided with a pair of engagement pegs configured to disengage locking engagement by moving the pair of engagement pegs below the top member thereby releasing a rotational arrest relative to the top member and further upon rotation of the rotary handle and stem into the second rotary position to engage, climb on and come to rest on an underside portion of the top member facing the retrievable subsea apparatus, thereby providing a rotational arrest of the rotary handle and the stem relative to the top member at such second rotary position.

3. The handling device of claim 1, wherein the top member is provided with a spring which assists in defining two distinct positions of the rotary handle and the stem, as well as the retrievable subsea apparatus when the retrievable subsea apparatus moves from a first position to a second position over a limited distance away from the top member when the hooks have entered into engagement with the rims.

4. The handling device of claim 3, wherein the rotary handle and the stem are in a rotary mode when the retrievable subsea apparatus is adjacent or at the second position.

* * * * *